United States Patent [19]

Matuura et al.

[11] 3,971,517

[45] July 27, 1976

[54] APPARATUS FOR WINDING A YARN ROUND A BOBBIN

[75] Inventors: Yosio Matuura; Shoichi Murakami; Norihisa Yamaguchi; Takashi Kishida; Sadao Kadokura; Kiyoshi Imai, all of Mihara, Japan

[73] Assignee: Teijin Limited, Osaka, Japan

[22] Filed: Aug. 12, 1974

[21] Appl. No.: 496,514

Related U.S. Application Data

[63] Continuation-in-part of Ser. No. 344,512, March 26, 1973, abandoned.

[30] Foreign Application Priority Data

| | | |
|---|---|---|
| May 15, 1972 | Japan | 47-47157 |
| May 15, 1972 | Japan | 47-47160 |
| May 27, 1972 | Japan | 47-52150 |
| June 8, 1972 | Japan | 47-56429 |
| June 8, 1972 | Japan | 47-66016[U] |

[52] U.S. Cl. ..... 242/18 R; 242/18 PW; 242/26.3; 242/43.1

[51] Int. Cl.[2] ..... B65H 54/02; B65H 54/32

[58] Field of Search ..... 242/158.2, 43, 43.1, 242/18 R, 18 A, 18 PW, 35.5 R, 26.1, 26.2, 26.3, 26.4, 27, 31, 32

[56] References Cited

UNITED STATES PATENTS

| | | | |
|---|---|---|---|
| 1,248,247 | 11/1917 | Bentley | 242/35.5 R |
| 1,904,726 | 4/1933 | Gribojedoff | 242/18 R X |
| 2,635,820 | 4/1953 | Cochran | 242/18 R |
| 2,764,363 | 9/1956 | Stammwitz | 242/26.2 |
| 2,811,319 | 10/1957 | Bakker | 242/35.5 R |
| 3,042,326 | 7/1962 | Lamb et al. | 242/26.3 |
| 3,550,871 | 12/1970 | Keith | 242/18 A |
| 3,559,903 | 2/1971 | McDermott et al. | 242/18 PW |
| 3,672,582 | 6/1972 | Allam et al. | 242/18 R |
| 3,682,403 | 8/1972 | Willis | 242/18 A |
| 3,688,998 | 9/1972 | Carr et al. | 242/18 A |

*Primary Examiner*—Stanley N. Gilreath
*Attorney, Agent, or Firm*—Eliot S. Gerber

[57] ABSTRACT

A guide roller is traversed substantially in parallel to the axis of an uprightly supported bobbin at a speed slow enough not to form appreciable twilled angles of a wound yarn. The yarn continuously extruded from a spinning apparatus at a speed higher than 2000 m/min is introduced substantially in parallel to the axis of the bobbin and changes its direction to right angles with respect to the axis of the bobbin while travelling through the guide roller. The guide roller traverses with shorter traverse strokes as the diameter of the wound yarn becomes larger.

6 Claims, 11 Drawing Figures

APPARATUS FOR WINDING A YARN ROUND A BOBBIN

Figure 1:
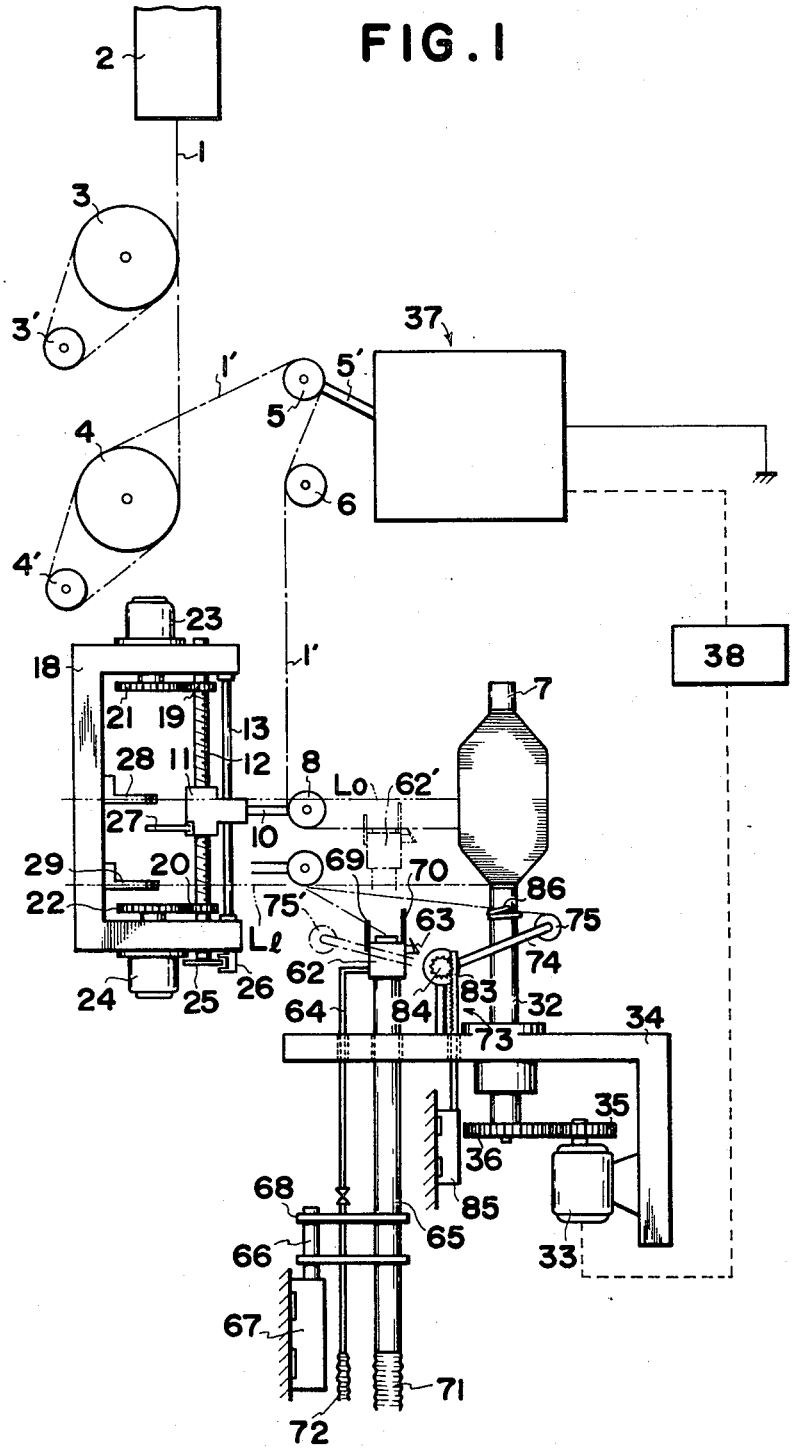

This is a continuation-in-part application of patent application Ser. No. 344,512 filed on Mar. 26, 1973, now abandoned.

This invention relates to a method and apparatus for winding a yarn round a bobbin without twisting, while the yarn is continuously extruded from a spinning apparatus at a speed higher than 2000 m/min.

Generally, in order to improve the production efficiency of synthetic yarns such as polyester yarn and polyamide yarn, there have been proposed a high speed spinning, a spin-drawing and a spin-draw texturing, in which the yarn is extruded from a spinning apparatus and wound round a bobbin at a speed higher than 2000 m/min. In such a high speed winding operation, in case the yarn is wound round a horizontally supported bobbin through a conventional yarn guide moving at speed of 100–300 m/min, the yarn traverses at a high speed within an angle between two lines formed by connecting a yarn delivery point with two returning points of the yarn guide, so that the length between the yarn delivery point and the yarn guide widely changes continuously. Accordingly, the friction applied to the yarn by the yarn guide changes continuously and, at the returning points, the yarn is temporarily not in contact with the yarn guide, so that no friction is applied to the yarn. Due to such wide changes of the friction, the wound yarn has subtle ununiformity in quality and an undesirable effect is exerted upon the shape of the package of the wound yarn.

Further, in such high speed winding operation, when the bobbin fully wound up by the yarn is changed with an empty one, it is desirable that the yarn continuously travelling through the yarn guide is speedily and positively wound round the empty bobbin even by an operator who is not skilled in such operation.

Accordingly, a main object of the present invention is to provide a method and apparatus for winding a yarn extruded from a spinning apparatus at a high speed, wherein changes of friction applied to the yarn while it is travelling from a spinning apparatus to a winding bobbin through yarn guide means are minimized to obtain uniform high quality of yarn.

Another object of the present invention is to provide a method and apparatus for hitching a yarn speedily and positively to an empty bobbin.

The inventors of the present application have found that even a small change of friction applied to a yarn extruded from a spinning apparatus at a speed higher than 2,000 m/min exerts a bad effect upon the quality of the yarn while the yarn is travelling from the spinning apparatus to a bobbin. According to the present invention, in order to minimize the changes of friction applied to the yarn, the yarn extruded from the spinning device is introduced substantially in parallel to an uprightly supported bobbin and changed its direction to right angles with respect to the axis of the winding bobbin through a guide roller. The guide roller traverses substantially in parallel to the axis of the winding bobbin at a speed slow enough not to form appreciable twilled angles of the wound yarn and to have shorter traverse strokes as the diameter of the wound yarn becomes larger. With such an arrangement, the amount of contact of the guide roller with the travelling yarn is substantially constant at any upper and lower positions of the guide roller. Therefore, the degree of friction applied to the yarn, while the latter is travelling, is almost constant and very small due to rotation of the guide roller, thus making it possible to obtain substantially uniform high quality of yarn. In addition, with the gradually decreasing traverse strokes, a stable package of the yarn can be obtained.

Preferably, the guide roller rotates on the same plane as the yarn travelling plane but it was found that if the guide roller is away from the bobbin for more than 10 cm, preferably, more than 20 cm, the guide roller may have the yarn travelling groove fixedly directed, without any problem, to the tangential direction of half-thickness of a package to be wound. The groove of the guide roller may have any shape, but, preferably is arc-shaped in cross section for facilitating the change of direction of the yarn.

Preferably, the traverse speed $Vt$ of the guide roller is in the range which satisfied the following inequality:

$$Vt < 0.002\ Vw$$

wherein $Vw$ is winding speed and $Vt$ is usually in the range of 0.01 – 0.1 m/sec.

In order to cut the travelling yarn when the bobbin is fully wound up by the yarn and to facilitate the next operation for winding, there is provided an aspirator having a cutter, which normally locates at a place not obstructive of the yarn traverse movement and moves up in parallel to the axis of the bobbin and cuts the yarn travelling between the guide roller and the bobbin, so that the continuously discharged yarn is pulled into the aspirator. The aspirator is constructed to move down to the above-mentioned normal place after pulling the yarn therein. It was also noted from the experiments that the aspirator can pull the yarn travelling at 4000 m/min.

Preferably, a yarn hitching means is provided which comprises a swing arm and a catching member at one end of the arm. The catching member is movable from a position between the guide roller and the aspirator to a position closely adjacent to the bobbin for hitching the yarn to a new empty bobbin.

Further, in order that the yarn may be wound round the empty bobbin without excessive tension, the empty bobbin is controlled to rotate at an initial peripheral speed slightly higher than the yarn travelling speed and then to rotate under a fixed tension.

Figure 2:
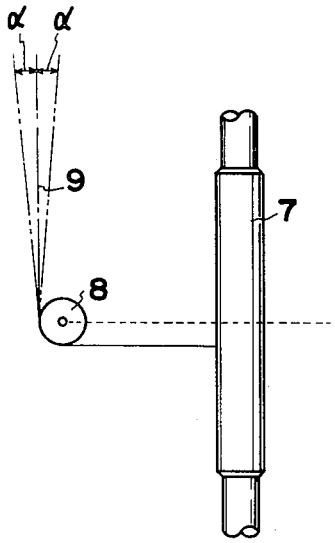
Figure 3:
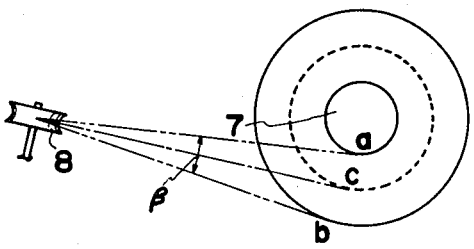
Figure 4:
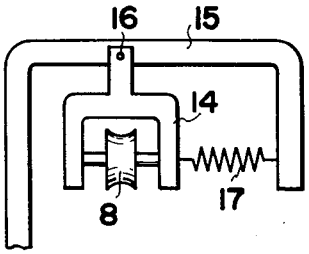
Figure 5:
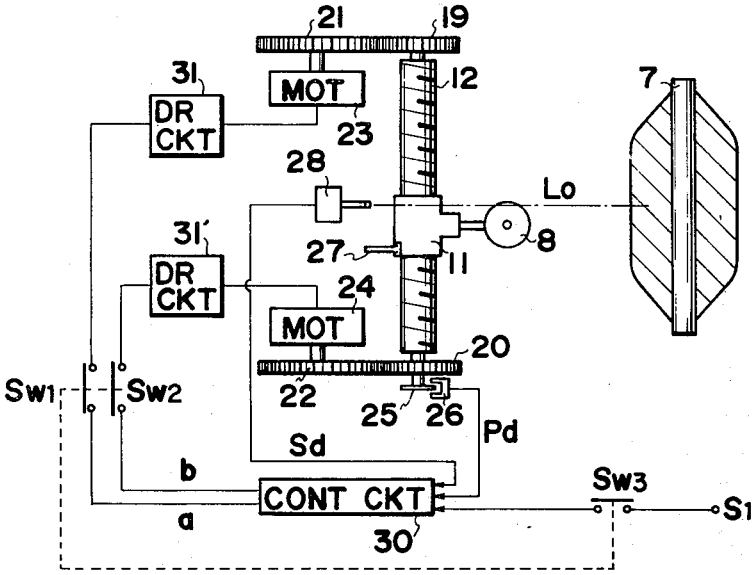
Figure 8:
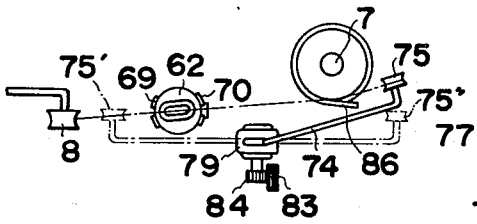
Figure 9:
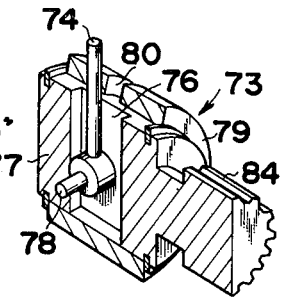
Figure 10:
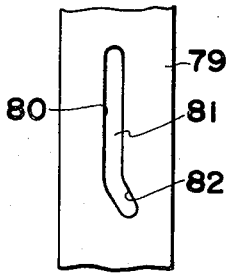
Figure 6:
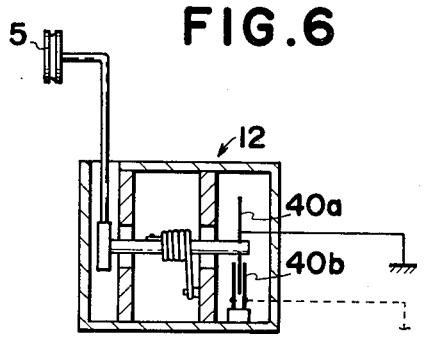
Figure 7:
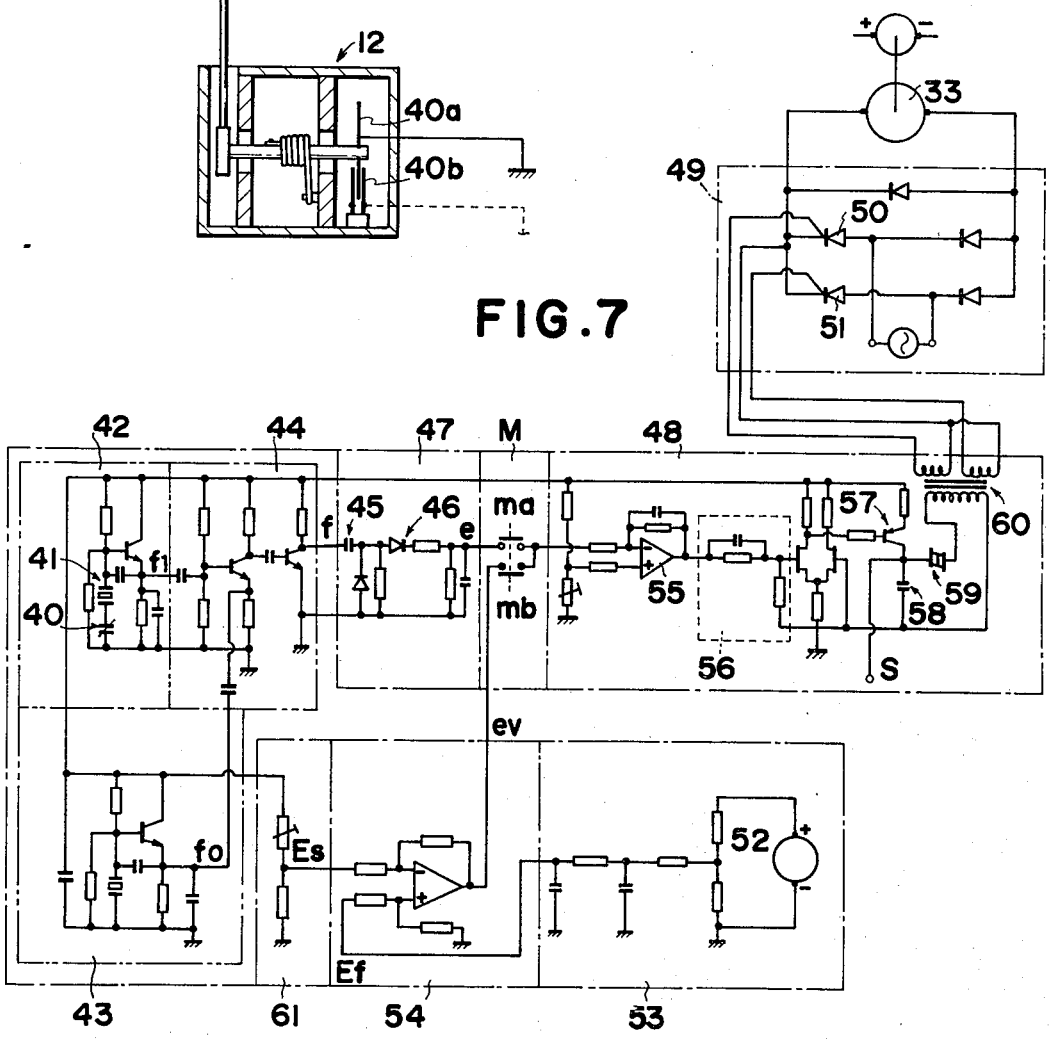
Figure 11:
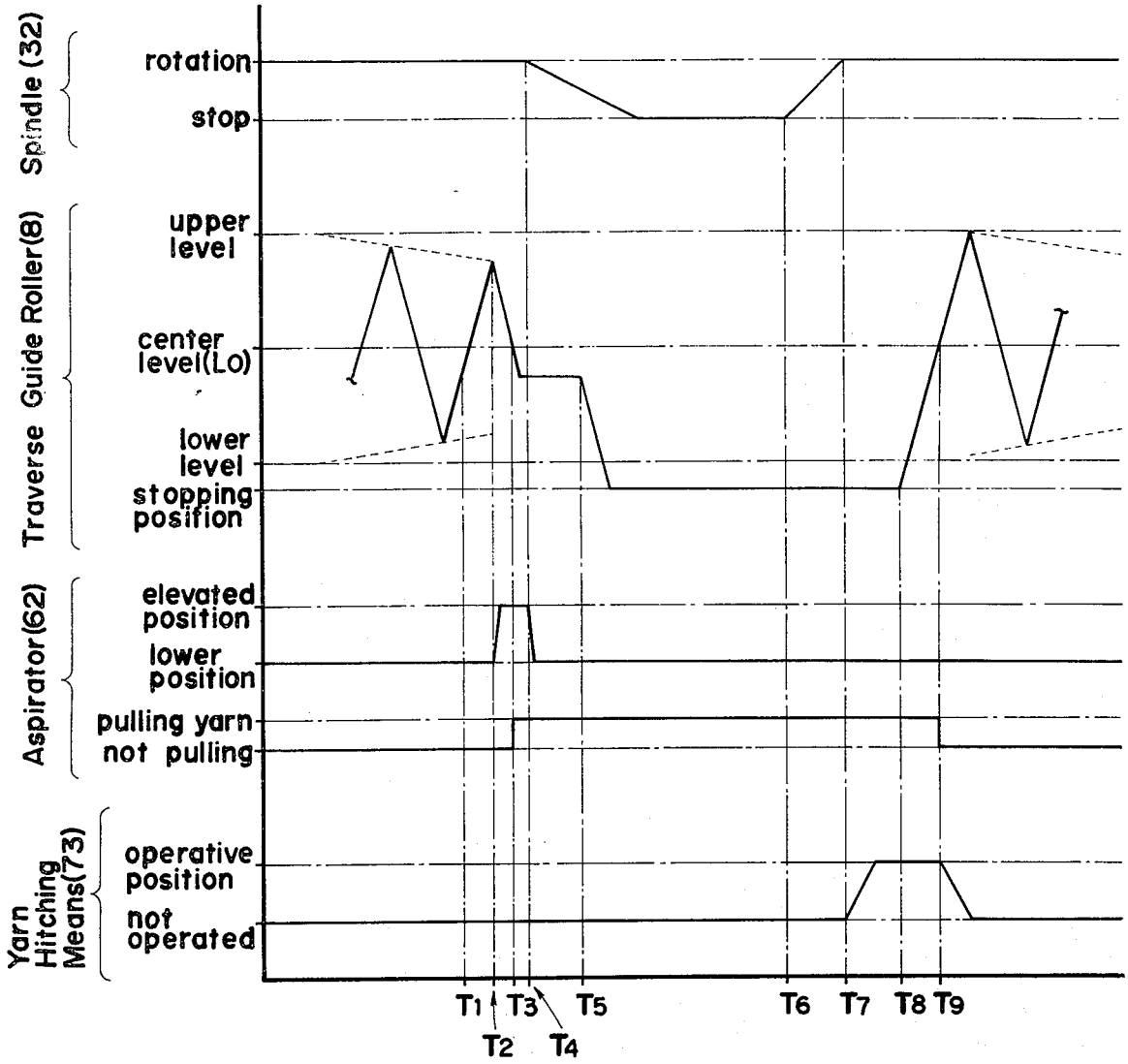

The aforementioned and other objects and features of the invention will be apparent from the following detailed description of specific embodiments thereof, when read in conjunction with the accompanying drawings, in which:

FIG. 1 is a side view schematically showing an apparatus of the present invention, FIG. 2 is a schematic side view showing allowable angles of yarn introduced to a guide roller, FIG. 3 is a schematic plan view showing relations of rotary plane of the guide roller and yarn travelling plane, FIG. 4 is a schematic front view showing an embodiment of the guide roller, FIG. 5 is a block diagram showing a drive mechanism for the guide roller, FIG. 6 is a partially sectioned side view showing a tension detecting means of a yarn travelling through a dancer roller, FIG. 7 is an electric circuit comprising a tension detecting circuit and a control circuit for driving the bobbin, FIG. 8 is a plane view showing a swing arm to hitch a yarn to a bobbin, FIG. 9 is a partial sectioned perspective view showing a bearing portion of the swing arm, FIG. 10 is a developed plane view showing a guide slot for the swing arm, and FIG. 11 is a diagram showing operational time relations when a yarn is fully wound round bobbin in the present invention.

Referring to FIG. 1, a yarn 1 is continuously discharged from a spinning apparatus 2. The spun yarn 1 is then subjected to drawing operation between feed and separate rollers 3, 3' and draw and separate rollers 4, 4' at a speed higher than 2,000 m/min. The drawn yarn 1' further travels through a dancer roller 5 mounted to a swingable arm 5' which is displaced in response to the tension applied to the yarn 1'. When the drawn yarn 1' travels through a direction guide roller 6 to a traverse guide roller 8, the yarn travelling direction becomes substantially parallel to an axis of a bobbin 7. Then, the yarn 1' changes its direction substantially to right angles with respect to the axis of the bobbin 7 while it travells through the traverse guide roller 8. The guide roller 8 traverses in substantially parallel to the axis of the bobbin 7 at a speed slow enough not to form appreciable twilled angles of the wound yarn, i.e. at a speed so slow that following laps are closely adjacent to but not overlap earlier laps in the same traverse.

It is most preferable that the yarn 1' travelling through the direction guide roller 6 is introduced to the traverse guide roller 8 precisely along a vertical line and in parallel to the axis of the bobbin 7. However, as shown in FIG. 2, it was noted from the experiments that when the yarn 1' is introduced to the traverse guide roller 8 within a certain range of angles $\alpha$ formed relative to a vertical line 9 which is parallel to the axis of the vertically supported bobbin 7, such small changes of friction applied to the yarn 1' while the guide roller 8 traverses exert no substantial effect upon the quality of the wound yarn. The allowable angles $\alpha$ at the position where the traverse guide roller 8 is central level relative to the length of the bobbin are in the range of $\pm 10°$, and preferably in the range of $\pm 5°$.

The traverse guide roller 8 is rotatably supported by a horizontal arm 10 which is integral with a threaded block 11 engaged with a screw shaft 12 and guided by a vertical rod 13. The guide roller 8 has, preferably, an arc-shaped groove therein as shown in FIG. 3. It is preferable that the rotary plane of the guide roller 8 is precisely coincident with the yarn travelling direction even though the yarn travelling plane changes from the initial yarn winding point (*a*) to the final yarn winding point (*b*) with an angle $\beta$ in FIG. 3. However, it was also noted that if the guide roller 8 is away from the bobbin 7 for more than 10 cm, preferably more than 20 cm, the guide roller 8 of which rotary plane is fixedly directed to a center point (*c*) which is tangential direction of half-thickness of the yarn to be wound exerts no substantial effect upon the quality of the yarn by changes of friction applied to the yarn.

A preferable structure of the guide roller 8 is shown in FIG. 4. In this structure, the guide roller 8 is rotatably supposed by a bearing frame 14 which is swingably pivoted to an angled frame member 15 by a pin 16. To eliminate vibrations of the guide roller 8 while the yarn 1' passes therethrough, a spring 17 having relatively low tension is disposed between an end portion of the frame member 15 and the bearing frame 14. The angled frame member 15 is secured at the other end portion to the threaded block 11 in FIG. 1. According to such a structure, while the yarn is wound round the bobbin, the guide roller 8 is swung about the pin 16 by the winding yarn tension, whereby the rotary plane of the guide roller 8 can precisely follow to the yarn travelling directions from the initial to final yarn winding points and eliminate any change of friction applied to the yarn by the guide roller 8.

Referring now to traverse means of the guide roller 8, the screw shaft 12 rotatably supported by a frame 18 has upper and lower gears 19 and 20 secured at the upper and lower portions thereof, respectively. The upper and lower gears 19 and 20 are engaged with gears 21 and 22 secured to output shafts of constant-speed servo motors 23 and 24, respectively. The servo motor 23 rotates the screw shaft 12 clockwise (viewed from the top of FIG. 1) via gears 19 and 21 and moves the threaded block 11 and the traverse guide roller 8 in the upper direction at a constant speed. The other servo motor 24 also rotates the screw shaft 12 counter-clockwise via gears 20 and 22 and moves the threaded block 11 and the traverse guide roller in the lower direction at a constant speed. At the lower end of the screw shaft 12 is attached a disc 25 having a number of equally spaced apart pores near its periphery. A stroke pulse generator 26 detects the pores in the disc 25 to produce stroke pulses Pd in proportion to the rotating angle of the disc 25, i.e. in proportion to the distance of the movement of the traverse guide roller 8. The stroke pulse generator 26 may be a conventional photoelectric pulse generator consisting of a light source and opposing photoelectric elements, such as phototransistor, and a pulse amplifier. Since the rotating speed of the screw shaft 12 is constant, the stroke pulse Pd is produced maintaining substantially a definite interval of time. A member 27 is attached to the block 11 at the opposite side of, and at substantially equal level to the traverse guide roller 8. Reference position detector 28 is attached to the frame 18 at a level L*o* which nearly conforms to the center levels of the bobbin 7 and the traverse strokes of the guide roller 8. The reference-position detector 28 which detects the passage of the member 27 may be of a conventional photoelectric type detector, like a stroke pulse generator.

According to the present invention, in order that the package of the wound yarn may not be deformed, the yarn is wound round the bobbin 7 with shorter traverse strokes as the diameter of the wound yarn becomes larger. To effect such traverse, a driving mechanism of the traverse guide roller 8 is illustrated below with reference to FIGS. 1 and 5. When an end of the yarn 1' is hitched to the bobbin 7 to start winding, the traverse guide roller 8 is set to the lower limit L*l*. Then switches $S_{w1}$, $S_{w2}$, $S_{w3}$ are closed and the initiation signal $S_1$ is transmitted to a control circuit 30. Initiation signal $S_1$ makes output *a* of the control circuit 30 to be ON (output *b* is OFF), and drive circuit 31 is operated. The servo motor 23 rotates the bobbin 7 clockwise, and the traverse guide roller 8 starts to move upward direction from the lower limit position L*l*. When the traverse guide roller 8 reaches the reference position Lo, the member 27 traverses over the detector 28, and the detector 28 produces reference position signal S*d*.

Upon receipt of the signal S*d*, the control circuit 30 starts to count stroke pulses P*d* transmitted from the stroke pulse generator 26. After the start of counting, when the number of stroke pulses P*d* entered to the control circuit 30 attains the setpoint value, output *a* of the control circuit 30 is made OFF and output *b* is made ON, so that the drive circuit 31 stops its operation and actuates a drive circuit 31' instead. As a result, the servo motor 24 rotates the screw shaft 12 counterclockwise, and the traverse guide roller 8 is reversed to travel downward direction. Also when the traverse guide roller 8 passes the reference position L*o*, reference position signal S*d* is generated causing the control circuit to start again the counting of stroke pulses P*d*. As the number of stroke pulses P*d* counted attains the setpoint value, the control circuit 30 makes the output *a* ON and output *b* OFF. The traverse guide roller 8 is again reversed to travel upward direction. The traverse guide roller 8 continues the reciprocating motion.

On the other hand, the control circuit 30 automatically and sequentially reduces the setpoint value for stroke pulses P*d* in a known manner, and hence the stroke of traverse guide roller 8 gets gradually shortened, acquiring so-called parallel wind motion. After a definite time or definite number of reciprocating motion, the control circuit 30 completes its winding in the parallel winding traverse motion. The traverse guide roller 8 is then lowered down until it is stopped at the height of lower limit position L*l* by means of lower limit position detector 29. But if desired, the traverse guide roller 8 may be stopped at a suitable position, e.g., just above the lower limit position L*l* for a short period of time for the purpose of forming a transfer tail.

Referring now to driving means for the bobbin 7, a vertical spindle 32 for the bobbin 7 is driven by a DC motor 33 secured to a frame 34 via a driving gear 35 and a follower gear 36. However, in place of these gears 35 and 36, other power transmission means such as belts and chains may be used, or the vertical spindle 32 may be directly connected with the motor 33. This motor 33 is electrically connected to a tension detecting electric circuit 37, which converts the displacement of the dancer roller 5 due to the tension variation of the yarn into an electric signal, and to a control circuit 38 for driving the bobbin 7.

The tension detecting circuit 37 comprises, as shown in FIGS. 6 and 7, an oscillation circuit 42 in which a variable condenser 40 having a rotor 40 (*a*) and a stator 40 (*b*), of which capacity is varied in response to the displacement of the dancer roller 5 due to the variation of the yarn tension, is connected in series with a crystal oscillator 41 to proportion its oscillation frequency $f_1$ with the condenser capacity, a reference oscillation circuit 43 for producing reference frequency *fo*, a mixing circuit 44 comparing the frequencies $f_1$ with *fo* and converting them to frequency *f* of the difference ($b = f_1 - fo$), and frequency-voltage converting circuit 47 differentiating the frequency *f* by the condenser 45, rectifying by diode 46, and smoothing by a circuit formed of condenser and resistance to convert into a voltage signal *e*.

This voltage signal *e* is applied through a contact of M*a* of switch M to a control circuit 38 for bobbin winding speed. Namely, the voltage signal *e* is applied to SCR phase control circuit 48 to control conduction angle of the SCR 50 and 51 of driving circuit 49, thereby controlling the rotary speed of DC motor 33.

In an example shown in FIG. 7, the control circuit 38 for the bobbin winding speed includes a differential amplification circuit 54 in which rotary speed of DC motor 33 is converted into a voltage signal E*f* by a speed detecting circuit 53 connected with a tachometer 52 and the voltage signal E*f* is compared with a reference voltage signal E*s* in a speed setting circuit 61 to produce output voltage signal *l*v. This signal *l*v is applied through SCR phase control circuit 48 through another contact *mb* in the switch M to control conduction angle of the SCR 50 and 51 of the driving circuit 49, thereby controlling the DC motor to constant speed. The SCR phase control circuit 48 comprises an amplifier 55, a compensating circuit 56, a transistor 57, a condenser 58, a synchronizing electric source S, SBS (Trade Mark) 59, and pulse transformer 60

Referring to FIGS. 1 and 8, an aspirator 62 having a yarn cutter 63 at its upper end is provided between the traverse guide roller 8 and the bobbin 7. The aspirator 62 passes through a frame 34 and moves up and down in parallel to the bobbin axis together with an air conduit 64 for a supplying compressed air for actuating the aspirator 62. A pipe 65 of the aspirator 62 is connected with a piston rod 66 of an air cylinder 67 by a metal fixture 68, so that the aspirator 62 is moved up and down by the air cylinder 67. At the upper end of the aspirator 62 are provided opposite yarn guide members 69 and 70, each of which has a V-shaped groove thereon. Though not shown in the drawings, the lower end portions of the pipe 65 of the aspirator 62 and the conduit 64 are connected to a reservoir and a compressed air means, respectively, through flexible tubes 71 and 72.

A yarn hitching means 73 is disposed through the frame 34 between the aspirator 62 and the bobbin 7. The hitching means 23 comprises a swing arm 74 to the upper end of which a roller 75 is mounted. As shown in FIG. 9, the lower end of the arm 74 partially passes into an elongated slot 76 of a rotary shaft 77 and rotatably connected to a pin 78 mounted to the rotary shaft 77 within the slot 76. The slot 76 is elongated along the axial direction of the rotary shaft 77, while the pin 78 is at right angles therewith. In a bearing 79 around the rotary shaft 77 there is provided a hooked slot 80 consisting of a first slot portion 81 and a second slot portion 82, as shown in FIG. 10. The swing arm 74 is so connected to the rotary shaft 77 through the hooked slot 80 that the swing arm 74 moves through the first slot portion 81 by rotation of the rotary shaft 77 and through the second slot portion 82 by rotation both of the rotary shaft 77 and the arm 74. Accordingly, when the roller 75 is at a position 75' shown by broken lines in FIGS. 1 and 8, it moves to a position 75'' in FIG. 8 as the arm comes to an end of the first slot portion 81 adjacent to the second slot portion 82 and moves to a position 75 shown by solid line in FIGS. 1 and 8 as it comes to an end of the second slot portion 82. Thus, the roller 75 comes close behind the bobbin 7. The rotary shaft 77 is rotated in the counter-clockwise and clockwise directions by moving up and down a rack 83 meshing with a pinion 84. The rack 83 is formed on a piston rod of an air cylinder 85, so that the upward and downward movements of the rack is controlled by operative fluid supplied in the air cylinder 85 and the length of the stroke thereof. The bobbin 7 is provided with a yarn catching hook 86 at the lower portion thereof.

The aforementioned apparatus is controlled by an electrical control means such as a computer to meet the predetermined drawing and winding operations as shown in FIG. 11. Namely, after a predetermined time period has passed from the start of winding, a wind completion signal is sent from the control means to the control circuit 30 in FIG. 5 at time $T_1$. Then, when the traverse guide roller 8 comes to the uppermost point of the traverse stroke at time $T_2$, a signal from the control circuit 30 is sent to the control means, from which a signal is sent to the air cylinder 67 to move the aspirator 62 upwards from the position shown by solid line to the position 62' shown by broken lines in FIG. 1. The air cylinder 67 for the aspirator 62 is actuated for a predetermined period of time by a timer, but the upper position of the aspirator 62 is defined by the broken lines in FIG. 1 since the length of the piston rod 66 of the air cylinder 67 is limited. When the guide roller 8 moves down and passes across the reference position *Lo* at the center level of the traverse stroke thereof, a signal from the detector 28 is sent via the control circuit 30 to the control means, from which a signal is sent to actuate the compressed air means for the aspirator 62 at time $T_3$. While the guide roller 8 further moves down, the yarn 1' travelling through the guide roller 8 to the winding bobbin 7 contacts with the cutter 63 at the upper end of the aspirator and is cut, so that one end of the yarn is wound round the bobbin 7 and the other end thereof is pulled into the aspirator 62 while the aspirator 62 is at the upper position. The guide roller 8 stops moving down after passing across the reference position Lo for a predetermined length counted by the disc 25 and the stroke pulse generator 26. Then, at time $T_4$, the aspirator 62 moves down with the yarn pulled therein as a predetermined period of time set by the timer has passed. At the same time $T_4$, a signal set by the timer is sent to the control means, from which a signal is sent to a power relay of the DC motor 33 to stop rotation of the DC motor 33. Then, the guide roller 8, which has been stopping for a predetermined period of time set by another timer, again moves down at time $T_5$ to the lowest position.

While the spindle 32 stops rotation, the package of the wound yarn is removed therefrom and an empty bobbin is supported to the spindle by an operator. Then, a signal to re-rotate the spindle 32 is sent to the DC motor by the operator at Time $T_6$. After a predetermined period of time set by another timer has passed, the spindle comes to have a predetermined rotary speed and a signal is sent via the control means to the yarn hitching means 73 to actuate the air cylinder 85 thereof at time $T_7$. Then, the rack 83 is moved down by the operation of the air cylinder 85 to rotate the pinion 84 in the clockwise direction, so that the arm 74 is rotated and shifted to the right hand position in FIGS. 1 and 3. At this time, the yarn having been pulled into the aspirator 62 is caught to the roller 75. When the arm 74 of the hitching means 75 is guided into the second slot 82 of the bearing 79 shown in FIG. 10, the roller 75 comes behind the empty bobbin and the yarn is hitched to the hook 86 of the bobbin. After a predetermined period of time has passed from the time $T_7$ by a timer, a signal to start traversing of the guide roller 8 is sent to the control circuit 30 via the control means at a time $T_8$. When the guide roller 8 passes across the reference position *Lo* at time $T_9$, a signal is sent to the compressed air means via the control circuit 30 and control means to stop the supply of the compressed air to the aspirator 62. Also, at the time $T_9$, the signal is sent to the air cylinder in the same way to move the rack 85 upwards and thereby return the arm 74 to the normal position 75' shown by broken lines in FIG. 1. Thus, the winding operation is continued for a predetermined period of time until the new bobbin is fully wound by the yarn.

EXAMPLE

With the use of the present drawing and winding apparatus shown in FIG. 1, polyamide yarn of 70 de/24 fil was drawn at the draw ratio of 3.0 by winding speed of 2200 m/min. A guide roller 8 coated with chrome plating and having a groove of outer diameter of 20 mm$\phi$ and inner diameter of 17 mm$\phi$ was provided with a space of 15 cm from the bobbin. It was predetermined so that the yarn is wound round the bobbin as thick as 4 cm. The guide roller 8 was arranged so that its groove is always directed to tangential direction of half-thickness (2 cm) of a package to be wound. The winding tention was set to be always 50 g by the dancer roller.

In such conditions, during winding operation, yarn breakage occurred 0.5 time for $10^6$ m and fluff of the yarn was 2.5 times for $10^6$ m. The result is favorable for industrial usage of high speed yarn winding round a bobbin.

What is claimed is:

1. An apparatus for winding a yarn round a bobbin without twisting, which comprises:

an uprightly supported bobbin;

means for driving said bobbin to wind the yarn extruded from a spinning apparatus at a speed higher than 2000 m/min.;

a guide roller rotatably mounted to a supporting arm;

means for introducing the yarn to said guide roller substantially in parallel to the axis of said bobbin;

means for slowly traversing said guide roller supporting arm substantially in parallel to the axis of said bobbin; and means for traversing said guide roller supporting arm with traverse strokes which gradually become shorter as the diameter of the wound yarn becomes larger;

said supporting arm comprising a bearing frame to which said guide roller is rotatably supported;

a frame member to which said bearing frame is swingably pivoted; and a tension spring disposed between said frame member and bearing frame.

2. An apparatus for winding a yarn round a bobbin without twisting, which comprises:

an uprightly supported bobbin;

means for driving said bobbin to wind the yarn extruded from a spinning apparatus at a speed higher than 2000 m/min.;

a guide roller rotatably mounted to a supporting arm;

means for introducing the yarn to said guide roller substantially in parallel to the axis of said bobbin;

means for slowly traversing said guide roller supporting arm substantially in parallel to the axis of said bobbin;

means for traversing said guide roller supporting arm with traverse strokes which gradually become shorter as the diameter of the wound yarn becomes larger;

an aspirator provided with a cutter at the upper end thereof, said aspirator being disposed between said bobbin and said guide roller; and means for moving said aspirator vertically up and down in parallel to the bobbin axis, said aspirator being normally located at a place below said traveling yarn between said guide roller and said bobbin, said aspirator being moved up when said bobbin is fully wound up to cut the traveling yarn and to pull the successively traveling yarn therein, and said aspirator being moved down after said yarn is pulled therein.

3. An apparatus for winding a yarn round a bobbin according to claim 2, further comprising:

a yarn catching hook provided at the lower portion of said bobbin; and a yarn hitching means having a swing arm to the upper end of which a yarn catching member is mounted, a rotary shaft to which the lower end of said swing arm is mounted to be rotated along the axis of said rotary shaft, said rotary shaft having a pinion at an end portion thereof, a rack meshing with said pinion and moved up and down while said yarn is being pulled into said aspirator, and means for guiding said yarn catching member below the yarn between said guide roller and said aspirator when said rack is moved up and for guiding said yarn catching member closely behind said yarn catching hook when said rack is moved down.

4. An apparatus for winding a yarn round a bobbin according to claim 2, wherein said aspirator comprises opposite yarn guide members at the upper end thereof and an air conduit moved up and down together with said aspirator for supplying compressed air in said aspirator while the latter is actuated.

5. An apparatus for winding a yarn round a bobbin according to claim 3, wherein said yarn catching member is a roller.

6. An apparatus for winding a yarn round a bobbin according to claim 3, wherein said guide means for said yarn catching member is a hooked slot formed in a bearing around said rotary shaft, said swing arm projecting through said hooked slot.

* * * * *